US007169291B1

(12) United States Patent
Wang

(10) Patent No.: US 7,169,291 B1
(45) Date of Patent: Jan. 30, 2007

(54) SELECTIVE HYDROCRACKING PROCESS USING BETA ZEOLITE

(75) Inventor: Li Wang, Bloomingdale, IL (US)

(73) Assignee: UOP LLC, Des Plaines, IL (US)

( * ) Notice: Subject to any disclaimer, the term of this patent is extended or adjusted under 35 U.S.C. 154(b) by 445 days.

(21) Appl. No.: 10/749,336

(22) Filed: Dec. 31, 2003

(51) Int. Cl.
*C10G 47/02* (2006.01)
*C10G 47/12* (2006.01)

(52) U.S. Cl. ..... 208/109; 108/111.3; 108/111.35

(58) Field of Classification Search ..... 208/108, 208/109, 111.3, 111.35
See application file for complete search history.

(56) References Cited

U.S. PATENT DOCUMENTS

| | | | | |
|---|---|---|---|---|
| 3,923,641 | A | 12/1975 | Morrison | 208/111 |
| 4,612,108 | A | 9/1986 | Angevine et al. | 208/111 |
| 4,757,041 | A | 7/1988 | Oleck et al. | 502/65 |
| 4,820,402 | A | 4/1989 | Partridge et al. | 208/111 |
| 4,911,823 | A | 3/1990 | Chen et al. | 208/67 |
| 4,983,273 | A | 1/1991 | Kennedy et al. | 208/89 |
| 5,128,024 | A | 7/1992 | LaPierre et al. | 208/89 |
| 5,228,979 | A | 7/1993 | Ward | 208/111 |
| 5,284,573 | A | 2/1994 | LaPierre et al. | 208/89 |
| 5,384,296 | A | 1/1995 | Tsao | 502/66 |
| 5,401,488 | A * | 3/1995 | Skeels et al. | 423/715 |
| 5,518,708 | A * | 5/1996 | Skeels et al. | 423/713 |
| 5,609,752 | A | 3/1997 | Del Rossi et al. | 208/144 |
| 5,688,975 | A * | 11/1997 | Nair et al. | 549/531 |
| 5,833,840 | A | 11/1998 | Absil et al. | 208/120 |
| 5,866,744 | A | 2/1999 | Wu et al. | 585/486 |
| 6,190,538 | B1 | 2/2001 | Gosselink et al. | 208/111.01 |
| 6,231,750 | B1 * | 5/2001 | Kasztelan et al. | 208/111.01 |
| 6,670,295 | B2 * | 12/2003 | Wang et al. | 502/66 |
| 7,048,845 | B2 * | 5/2006 | Bauer | 208/111.01 |
| 2002/0094931 | A1 | 7/2002 | Wang et al. | 502/63 |

FOREIGN PATENT DOCUMENTS

| | | |
|---|---|---|
| EP | O 955 093 A1 | 11/1999 |
| JP | 11-156198 | 6/1999 |

OTHER PUBLICATIONS

Database WPI Section CH, Week 200001 Derwent Publications Ltd., London, GB; Class H06, AN 1999-348058 XP002237545 & JP 11 156198 A (China Petrochemical Corp), Jun. 15, 1999 abstract.

* cited by examiner

*Primary Examiner*—Tam M. Nguyen
(74) *Attorney, Agent, or Firm*—John G. Tolomei; Michael A. Moore

(57) ABSTRACT

Increased yields of middle distillate products are obtained in a hydrocracking process by the use of a catalyst containing a beta zeolite. In embodiments, the beta zeolite has not been hydrothermally treated or has been hydrothermally treated at a relatively low temperature. In another embodiment, the catalyst contains a relatively low amount of beta zeolite.

26 Claims, 1 Drawing Sheet

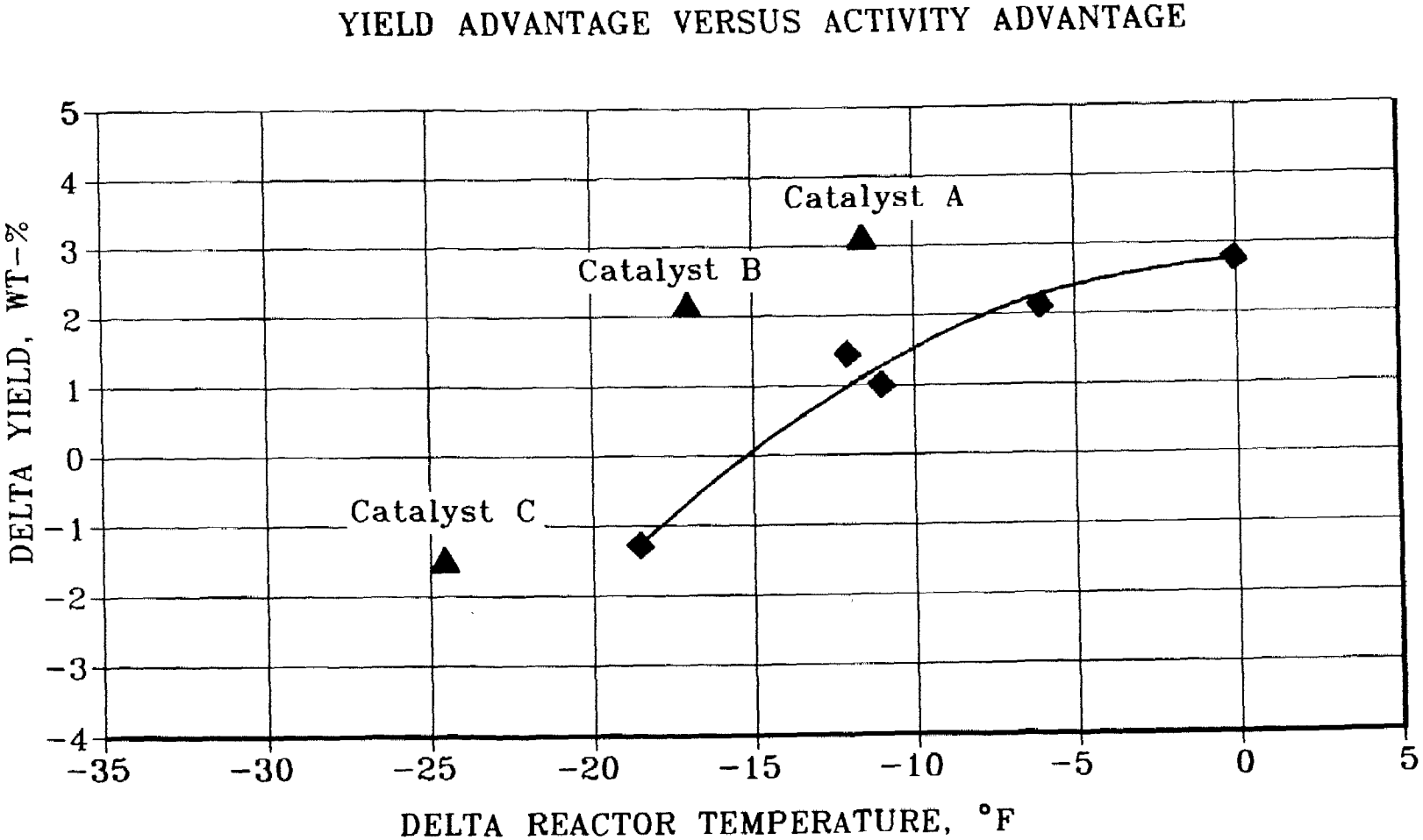
YIELD ADVANTAGE VERSUS ACTIVITY ADVANTAGE
Catalyst A
Catalyst B
Catalyst C
DELTA YIELD, WT-%
5
4
3
2
1
0
-1
-2
-3
-4
DELTA REACTOR TEMPERATURE, °F
-35
-30
-25
-20
-15
-10
-5
0
5

SELECTIVE HYDROCRACKING PROCESS USING BETA ZEOLITE

FIELD OF THE INVENTION

The invention relates to a hydrocarbon conversion process referred to in the art as hydrocracking. The invention specifically relates to a hydrocracking process, which produces increased quantities of middle distillate boiling range products. The invention more specifically relates to a hydrocracking process, which employs a catalyst comprising a beta zeolite as an active cracking component.

BACKGROUND OF THE INVENTION

Hydrocracking is a basic conversion process used in many petroleum refineries worldwide to reduce the molecular weight of petroleum derived feedstocks and convert the feedstock into more valuable products such as motor fuel, diesel fuel and lubricants. Hydrocracking also has other beneficial results such as removing sulfur and nitrogen from the feedstock by hydrodesulfurization. While the overall physical design of a hydrocracking process can be very important to the level of conversion and selectivity achieved by a hydrocracking process, these two measures of performance are always also tied to the abilities of the hydrocracking catalyst employed in the process.

Hydrocracking catalysts are subject to initial classification on the basis of the nature of the predominant cracking component of the catalyst. This classification divides hydrocracking catalysts into those based upon an amorphous cracking component such as silica-alumina and those based upon a zeolitic cracking component such as Y zeolite. Hydrocracking catalysts are also subject to classification on the basis of their intended predominant product of which the two main products are naphtha and "distillate", a term which in the hydrocracking refining art refers to distillable petroleum derived fractions having a boiling point range which is above that of naphtha. Distillate typically includes the products recovered at a refinery as kerosene and diesel fuel. The process disclosed herein relates to a zeolitic catalyst having improved selectivity for the production of distillate boiling range hydrocarbons. These catalysts normally comprise a zeolite component and a support or other component such as alumina or silica-alumina and a metal hydrogenation component.

RELATED ART

Zeolite beta has been proposed as a component of several different catalysts including catalysts for hydrocracking and hydrodewaxing. For instance, U.S. Pat. No. 3,923,641 issued to R. A. Morrison describes hydrocracking $C_5^+$ and $C_7^+$ naphthas to produce a high isobutane-normal butane ratio product using zeolite beta.

U.S. Pat. No. 4,612,108 issued to P. J. Angevine et al. describes a hydrocracking process which employs a catalyst comprising a beta zeolite. The catalyst is described as being effective in dewaxing of an unconverted portion of the charge stock and in partial conversion of the charge stock.

U.S. Pat. No. 4,757,041 issued to S. M. Oleck et al describes the simultaneous hydrocracking and dewaxing of heavy oils using a catalyst comprising zeolite beta plus a second zeolite such as X or Y zeolite.

U.S. Pat. No. 4,820,402 issued to R. D. Partridge et al. presents a hydrocracking process described as providing selectivity for the production of middle distillate range products. This increased selectivity is attributed to the use of a catalyst containing a highly siliceous large pore zeolite as the acidic component of a catalyst. Zeolite beta is indicated as being a suitable zeolite for this catalyst when it has a silica:alumina ratio of at least 50:1.

U.S. Pat. No. 4,983,273 issued to C. R. Kennedy et al. describes a hydrocracking process employing a catalyst based on zeolite beta. The process as presenting several improvements due to unique process flows which include partial recycle of the liquid products. The beta zeolite preferably has a silica:alumina ratio greater than 30:1.

U.S. Pat. No. 5,228,979 describes a process for hydrocracking of hydrocarbon feedstocks in an ammonia rich environment using a catalyst comprising zeolite beta and a noble metal hydrogenation component, preferably palladium. This reference describes the silica:alumina ratio of the beta zeolite as being between 10 and 100 and preferably less than 40. There is also set out preferred water and cyclohexane adsorption capacities for the beta zeolite. These characteristics of the zeolite are described as providing a high activity hydrocracking catalyst.

U.S. Pat. Nos. 5,128,024 and 5,284,573 issued to R. B. LaPierre et al. describe hydrocarbon conversion processes in which heavy oils are simultaneously subjected to hydrocracking and dewaxing using a catalyst based upon zeolite beta with a hydrogenation component.

U.S. Pat. No. 6,190,538 B1 issued to J. W. Gosselink et al. describes the preparation of a catalyst which comprises zeolite beta as a first of two cracking components. The preferred beta is described as employed in the form of a small crystal having a silica:alumina ratio greater than 20 and preferably greater than 25 as for instance 120–150.

U.S. Pat. No. 6,231,750 B1 issued to S. Kasztelan et al. presents a hydrocracking catalyst comprising a matrix, a beta zeolite, a Group VB element and at least one mixed sulfide phase. The beta zeolite preferably has a silicon to alumina ratio of from 10 to 200 and more preferably of 10 to 150. It is indicated the beta zeolite can be dealuminated and should have a surface area greater than 400 square meters per gram.

Finally, Japanese unexamined patent publication published Jun. 15, 1999 based upon application 11-156198 describes a hydrocracking process for the production of middle distillates which employs a catalyst comprising beta zeolite and silica-alumina. The beta zeolite is dealuminated by acid treatment and then hydrothermally treated. The treated beta zeolite is characterized in terms of its total acidity, measured by pyridine adsorption, and adsorption capacity for water.

SUMMARY OF THE INVENTION

It has been discovered that a middle distillate hydrocracking catalyst containing beta zeolite that has a silica:alumina molar ratio of less than 30:1 and a $SF_6$ adsorption capacity of at least 28 wt-% has good selectivity and activity. The beta zeolite does not require steam treatment, although the beta zeolite can be steamed. The catalyst contains a metal hydrogenation component such as nickel, cobalt, tungsten, molybdenum, or any combination thereof.

It is believed that a hydrocracking catalyst containing the subject beta zeolite is novel to the art.

One embodiment of the process disclosed herein can be summarized as a hydrocracking process which comprises contacting a feed stream comprising hydrocarbons having boiling points between about 340° C. (664° F.) and about 565° C. (1049° F.) with a catalyst comprising a hydrogenation component and beta zeolite. The hydrogenation component comprises a metal component such as nickel, cobalt, tungsten, molybdenum, or any combination. The beta zeolite has a silica:alumina molar ratio of less than 30:1 and a $SF_6$ adsorption capacity of at least 28 wt-%.

BRIEF DESCRIPTION OF THE DRAWING

The drawing is a chart of the yield advantage of tested catalysts compared to a reference catalyst plotted versus the activity advantage expressed in terms of reactor temperature compared to the reference catalyst.

DETAILED DESCRIPTION

The relative values of the different products of a petroleum refinery are set by a variety of factors including local consumption patterns, and climate. In some locations there is a great economic advantage to producing naphtha boiling range hydrocarbons. In other locations there is a preference for producing the heavier (higher boiling) diesel and kerosene fractions. While the product distribution from an existing hydrocracking unit can be adjusted to a limited extent by changes in feed stock and operation conditions, the yield characteristics of the catalyst used in the process is often of high if not determining importance. As the relative demand for distillate is increasing in many areas faster than the demand for naphtha boiling hydrocarbons, many refineries are attempting to increase their distillate production.

In addition it is very important to refinery economics to avoid over conversion of the feedstock. Such non-selective cracking results in the production of larger percentages of undesired, lower value products such as $C_4^-$ hydrocarbons. Thus the selectivity of the hydrocracking process in producing the desired distillate products becomes very important. There is, therefore, a continuing economic advantage in providing catalysts that are more selective. It is an objective of the process disclosed herein to provide an active hydrocracking catalyst and process which is selective for the production of distillate boiling range hydrocarbons.

As shown by the numerous references cited above, beta zeolite is well known in the art as a component of hydrocracking catalysts. Beta zeolite is described in U.S. Pat. No. 3,308,069 and Re No. 28,341, which are incorporated herein for their description of this material. The cited references also indicate that hydrocracking conditions and procedures are widely described in the literature. The zeolite beta that is used in the process disclosed herein has a silica:alumina molar ratio ($SiO_2$:$AI_2O_3$) of less than 30:1 in one embodiment, of less than 25:1 in another embodiment, of more than 9:1 and less than 30:1 in yet another embodiment, of more than 9:1 and less than 25:1 in a fourth embodiment, of more than 20:1 and less than 30:1 in a fifth embodiment, and of more than 15:1 and less than 25:1 in a sixth embodiment.

The beta zeolite is usually synthesized from a reaction mixture containing a templating agent. The use of templating agents for synthesizing beta zeolite is well known in the art. For example, U.S. Pat. No. 3,308,069 and Re No. 28,341 describe using tetraethylammonium hydroxide and U.S. Pat. No. 5,139,759, which is incorporated herein, describes using the tetraethylammonium ion derived from the corresponding tetraethylammonium halide. It is believed that the choice of a particular templating agent is not critical to the success of the process disclosed herein. In one embodiment the beta zeolite is calcined in air at a temperature of from 500 to 700° C. (932 to 1292° F.) for a time sufficient to remove to remove the templating agent from the beta zeolite. Calcination to remove the templating agent can be done before or after the beta zeolite is combined with the support and/or the hydrogenation component. Although it is believed that the templating agent could be removed at calcination temperatures above 700° C. (1292° F.), very high calcination temperatures could significantly decrease the $SF_6$ adsorption capacity of beta zeolite. For this reason it is believed that calcination temperatures above 750° C. (1382° F.) for removing the templating agent should be avoided when preparing the beta zeolite for use in the process disclosed herein. It is critical to the process disclosed herein that the $SF_6$ adsorption capacity of the beta zeolite is at least 28 wt-%.

Hydrothermally treating zeolites for use in hydrocracking catalysts is known. Nevertheless, steaming is a relatively blunt tool. For any given zeolite, steaming decreases the acidity of the zeolite. When the steamed zeolite is used as a hydrocracking catalyst, the apparent result is that the overall distillate yield increases but the catalyst's activity decreases. This apparent tradeoff between yield and activity has meant that to achieve high activity means not to steam the zeolite, but at the expense of lower product yields. This apparent tradeoff between overall distillate yield and activity must be considered and is a limit to the improvement, which appears to be obtainable by steaming the zeolite. In comparison, the process disclosed herein is centered around using beta zeolite in hydrocracking catalyst in a manner which improves both activity and yields for middle distillate products.

The hydrocracking process disclosed herein centers on using relatively low amounts of a zeolite beta having a relatively low silica:alumina molar ratio and a relatively high $SF_6$ adsorption capacity. It has been found that differing performance results when such zeolite beta is incorporated in hydrocracking catalysts in this way. Not only is the activity of the hydrocracking catalyst higher than that of catalysts containing steamed beta zeolite, but unexpectedly the product yield is higher too.

The catalyst used in the process disclosed herein is intended primarily for use as a replacement catalyst in existing commercial hydrocracking units. Its size and shape is, therefore, preferably similar to those of conventional commercial catalysts. It is preferably manufactured in the form of a cylindrical extrudate having a diameter of from about 0.8–3.2 mm (1/32–1/8 in). The catalyst can however be made in any other desired form such as a sphere or pellet. The extrudate may be in forms other than a cylinder such as the form of a well-known trilobe or other shape which has advantages in terms or reduced diffusional distance or pressure drop.

Commercial hydrocracking catalysts contain a number of non-zeolitic materials. This is for several reasons such as particle strength, cost, porosity, and performance. The other catalyst components, therefore, make positive contributions to the overall catalyst even if not as active cracking components. These other components are referred to herein as the support. Some traditional components of the support such as silica-alumina normally make some contribution to the cracking capability of the catalyst. In one embodiment, the catalyst of the process disclosed herein contains a positive amount less than 3 percent beta zeolite by weight based on the combined weight of the beta zeolite and the support on a volatile-free basis. Volatile-free basis means the weight of each of the beta zeolite and the support is determined after each has been heated at 500° C. (932° F.) to drive off all volatile matter. Based on the combined weight of the beta zeolite and the support on a volatile-free basis, the zeolite content of the catalyst used in the process disclosed herein is a positive amount less than 2 wt-% in another embodiment, less than 1.5 wt-% in a third embodiment, less than 1 wt-% in a fourth embodiment, less than 0.5 wt-% in a fifth embodiment, and from 0.1 to 2 wt-% in a sixth embodiment. The remainder of the catalyst particle besides the zeolitic material may be taken up primarily by conventional hydrocracking materials such as alumina and/or silica-alumina. The presence of silica-alumina helps achieve the desired performance characteristics of the catalyst. In one embodiment the catalyst contains at least 25 wt-% alumina and at least 25 wt-% silica-alumina based on the weight of the catalyst. In another embodiment, the silica-alumina content of the catalyst is above 40 wt-% and the alumina content of the catalyst is above 35 wt-%, both based on the weight of the catalyst. However, the alumina is believed to function only as a binder and to not be an active cracking component. The catalyst support may contain over 50 wt-% silica-alumina or over 50 wt-% alumina based on the weight of the support. Approximately equal amounts of silica-alumina and alumina are used in an embodiment. Other inorganic refractory materials which may be used as a support in addition to silica-alumina and alumina include for example silica, zirconia, titania, boria, and zirconia-alumina. These aforementioned support materials may be used alone or in any combination.

Besides the beta zeolite and other support materials, the subject catalyst contains a metallic hydrogenation component. The hydrogenation component is preferably provided as one or more base metals uniformly distributed in the catalyst particle. Noble metals such as platinum and palladium could be applied but best results have been obtained with a combination of two base metals. Specifically, either nickel or cobalt is paired with tungsten or molybdenum, respectively. The preferred composition of the metal hydrogenation component is both nickel and tungsten, with the amount by weight of the elemental metal of tungsten being about two to three times the amount of nickel. The amount of nickel or cobalt is preferably between about 2 and 8 weight percent of the finished catalyst. The amount of tungsten or molybdenum is preferably between about 8 and about 22 weight percent of the finished catalyst. The total amount of a base metal hydrogenation component is from about 10 to 30 weight percent.

The catalyst of the subject process can be formulated using industry standard techniques. This can, with great generalization, be summarized as admixing the beta zeolite with the other inorganic oxide components and a liquid such as water or a mild acid to form an extrudable dough followed by extrusion through a multihole die plate. The extrudate is collected and preferably calcined at high temperature to harden the extrudate. The extruded particles are then screened for size and the hydrogenation components are added as by dip impregnation or the well known incipient wetness technique. If the catalyst contains two metals in the hydrogenation component these may be added sequentially or simultaneously. The catalyst particles may be calcined between metal addition steps and again after the metals are added. The finished catalyst should have a surface area between about 300 and 550 $m^2/g$ and an average bulk density (ABD) of about 0.9 to 0.96 g/cc.

The subject hydrocracking process will be operated within the general range of conditions now employed commercially in hydrocracking processes. The operating conditions in many instances are refinery or processing unit specific. That is, they are dictated in large part by the construction and limitations of the existing hydrocracking unit, which normally cannot be changed without significant expense, the composition of the feed and the desired products. The inlet temperature of the catalyst bed should be in the range of from about 232 to about 454° C. (450–850° F.), and the inlet pressure should be above about 6895 kpa(g) (1,000 psi(g)). The feed stream is admixed with sufficient hydrogen to provide hydrogen circulation rate of about 168 to 1684 n.l/l (1000 to 10000 SCF/barrel, hereafter SCFB) and passed into one or more reactors containing fixed beds of the catalyst. The hydrogen will be primarily derived from a recycle gas stream which may pass through purification facilities for the removal of acid gases although this is not necessary. The hydrogen rich gas admixed with the feed and in one embodiment any recycle hydrocarbons will contain at least 90 mol percent hydrogen. For distillate hydrocracking the feed rate in terms of liquid hourly space velocity (L.H.S.V.) will normally be within the broad range of about 0.3 to 1.5 $hr^{-1}$, with a L.H.S.V. below 1.2 being used in one embodiment.

The typical feed to the subject process is a mixture of many different hydrocarbons and coboiling compounds recovered by fractional distillation from a crude petroleum. It will normally have a boiling point range starting above about 340° C. (644° F.) and ending in one embodiment below about 482° C. (900° F.), in another embodiment below about 540° C. (1004° F.), and in a third embodiment below about 565° (1049° F.). Such a petroleum derived feed may be a blend of streams produced in a refinery such as coker gas oil, straight run gas oil, deasphalted gas oil and vacuum gas oil. Alternatively, it can be a single fraction such as a heavy vacuum gas oil. Synthetic hydrocarbon mixtures such as recovered from shale oil or coal can also be processed in the subject process. The feed may be subjected to hydrotreating or treated as by solvent extraction prior to being passed into the subject process to remove gross amounts of sulfur, nitrogen or other contaminants such as asphaltenes. The subject process is expected to convert a large portion of the feed to more volatile hydrocarbons such as naphtha and diesel boiling range hydrocarbons. Typical conversion rates vary between about 50 and 90 vol-% depending greatly on the feed composition. The conversion rate is between about 60 and 90 vol-% in an embodiment of the process disclosed herein, between about 70 and 90 vol-% in another embodiment, between about 80 and 90 vol-% in yet another embodiment, and between about 65 and 75 vol-% in still another embodiment. The effluent of the process will actually contain a broad variety of hydrocarbons ranging from methane to essentially unchanged feed hydrocarbons boiling above the boiling range of any desired product. The hydrocarbons boiling above the boiling point of any desired product are referred to as unconverted products even if their boiling point has been reduced to some extent in the process. Most unconverted hydrocarbons are recycled to the reaction zone with a small percentage e.g. 5 vol-% being removed as a drag stream.

The subject catalyst can be employed in what are referred to in the art as single stage and two stage process flows, with or without prior hydrotreating. These terms are used as defined and illustrated in the text *Hydrocracking Science and Technology* by J. Scherzer and A. J. Gruia, 1996, Marcel Dekker Inc., ISBN 0-8247-9760-4. In a two-stage process the subject catalyst can be employed in either the first or second stage. The catalyst may be preceded by a hydrotreating catalyst in a separate reactor or may be loaded into the same reactor as a hydrotreating catalyst or a different hydrocracking catalyst. An upstream hydrotreating catalyst can be employed as feed pretreatment step or to hydrotreat recycled unconverted materials. The hydrotreating catalyst can be employed for the specific purpose of hydrotreating polynuclear aromatic (PNA) compounds to promote their conversion in subsequent hydrocracking catalyst bed(s). The subject catalyst can also be employed in combination with a second, different catalyst, such as a catalyst based upon Y zeolite or having primarily amorphous cracking components.

In some embodiments of the process disclosed herein, the catalyst is employed with a feed or in a configuration that the feed passing through the catalyst is a raw feed or resembles a raw feed. The sulfur content of crude oil, and hence the feed to this process, varies greatly depending on its source. As used herein, a raw feed is intended to refer to a feed which has not been hydrotreated or which still contains organic sulfur compounds which result in a sulfur level above 1000 wt-ppm or which still contains organic nitrogen compounds that result in a nitrogen level above 100 wt-ppm (0.01 wt-%).

In other embodiments of the process disclosed herein, the catalyst is used with a feed that has been hydrotreated. Persons of ordinary skill in the art of hydrocarbon processing know and can practice hydrotreating of a raw feed to produce a hydrotreated feed to be charged to the process disclosed herein. Although the sulfur level of the feed may be between 500 and 1000 wt-ppm, the sulfur level of the hydrotreated feed is less than 500 wt-ppm in one embodiment of the process disclosed herein and from 5 to 500 wt-ppm in another embodiment. The nitrogen level of the hydrotreated feed is less than 100 wt-ppm in one embodiment and from 1 to 100 wt-ppm in another embodiment.

While it is known that steaming a zeolite such as beta results in changes to the actual crystalline structure of the zeolite, the abilities of present day analytical technology have not made it possible to accurately monitor and/or characterize these changes in terms of important structural details of the zeolite. The situation is more complicated in the case of beta zeolite as compared to Y zeolite since there are nine different tetrahedral aluminum sites in beta zeolite but only one in Y zeolite. Instead, measurements of various physical properties of the zeolite such as surface area are used as indicators of changes that have occurred and the extent of the changes. For instance, it is believed that a reduction in the zeolite's capacity to adsorb sulfur hexafluoride ($SF_6$) after being steamed is believed to be caused by a reduction in the crystallinity of the zeolite or in the size or accessibility of the zeolite's micropores. It is, however, an indirect correlation of the changes in the zeolite that may be undesirable, since the $SF_6$ adsorption capacity in the catalyst used in the process disclosed herein is relatively high. In one embodiment of the process disclosed herein, the $SF_6$ adsorption capacity of the beta zeolite, whether steam treated or not, should be at least 28 wt-%.

Although in one embodiment of the process disclosed herein the beta zeolite has not been subjected to a steaming treatment, in other embodiments of the process disclosed herein the beta zeolite may be subjected to steaming, but the steaming is relatively mild in comparison to steaming of beta zeolite in the literature. Under the proper conditions and for the proper time, steaming zeolite beta has been found to yield a catalyst that can be used in the process disclosed herein. There is, as previously mentioned, an apparent tradeoff between overall distillate yield and activity that must be considered, and so there may be a limit to the improvement which appears to be obtainable by steaming the zeolite.

Steaming of the beta zeolite can be performed successfully in different ways, with the method which is actually employed commercially often being greatly influenced and perhaps dictated by the type and capability of the available equipment. Steaming can be performed with the zeolite retained as a fixed mass or with the zeolite being conveyed by means of a belt or being agitated in a rotating kiln. The important factors are uniform treatment of all zeolite particles under appropriate conditions of time, temperature and steam concentration. For instance, the zeolite should not be placed such that there is a significant difference in the amount of steam contacting the surface and the interior of the zeolite mass. In one embodiment, the beta zeolite is steam treated in an atmosphere having live steam passing through the equipment providing low steam concentration. This may be described as being at a steam concentration of a positive amount less than 50 mol-%. Steam concentrations may range from 1 to 20 mol-% in one embodiment and from 5 to 10 mol-% in another embodiment, with small-scale laboratory operations extending toward higher concentrations. The steaming in one embodiment is performed for a positive time period of less than or equal to 1 or 2 hours or for 1 to 2 hours at a temperature of less than or equal to about 600° C. (1112° F.) at atmospheric pressure and a positive content of steam of less than or equal to 5 mol-%. The steaming in another embodiment is performed for a positive time period of less than or equal to 2 hours at a temperature of less than or equal to about 650° C. (1202° F.) at atmospheric pressure and a positive content of steam of less than or equal to 10 mol-%. The steam contents are based on the weight of vapors contacting the zeolite beta. Steaming at temperatures above 650° C. (1202° F.) appears to result in zeolite that is not useful in the process disclosed herein since the $SF_6$ adsorption capacity of the resulting zeolite beta is too low. Temperatures below 650° C. (1202° F.) can be used, and the steaming temperature can be from about 600° C. (1112° F.) to about 650° C. (1202° F.) in one embodiment and less than 600° C. (1112° F.) in another embodiment. It is taught in the art that there is normally an interplay between time and temperature of steaming, with an increase in temperature reducing the required time. Nevertheless, if steaming is done, for good results it appears a time period of about ½ to 2 hours can be used in one embodiment and about 1 to 1½ hours in another embodiment. In one embodiment, the method of performing steaming on a commercial scale is by means of a rotary kiln having steam injected at a rate which maintains an atmosphere of about 10 mol-% steam.

The beta zeolite of the process disclosed herein is in one embodiment not treated with an acid solution to effect dealumination. In this regard it is noted that essentially all raw (as synthesized) zeolite is exposed to an acid to reduce the concentration of sodium which remains from synthesis. This step in the zeolite manufacture procedure is not considered part of the treatment of manufactured zeolite as described herein. In one embodiment, during the treatment and catalyst manufacturing procedures the zeolite is only exposed to an acid during incidental manufacturing activities such as peptization during forming or during metals impregnation. In one embodiment, the zeolite is not acid washed after the steaming procedure as to remove aluminum "debris" from the pores.

An exemplary lab scale steaming procedure is performed with the zeolite held in a 6.4 cm (2½ inch) quartz tube in a clam shell furnace. The temperature of the furnace is slowly ramped up by a controller. After the temperature of the zeolite reaches 150° C. (302° F.) steam generated from deionized water held in a flask is allowed to enter the bottom of the quartz tube and pass upward. Other gas can be passed into the tube to achieve the desired steam content. The flask is refilled as needed. In the exemplary procedure the time between cutting in the steam and the zeolite reaching 600° C. (1112° F.) was about one hour. At the end of the set steam period the temperature in the furnace is reduced by resetting the controller to 20° C. (68° F.). The furnace is allowed to cool to 400° C. (752° F.) (about 2 hours) and the flow of steam into the quartz tube is stopped. The sample is removed at 100° C. (212° F.) and placed in a lab oven held overnight at 110° C. (230° F.) with an air purge.

The beta zeolite of the process disclosed herein may also be characterized in terms of $SF_6$ adsorption. This is a recognized technique for the characterization of microporous materials such as zeolites. It is similar to other adsorption capacity measurements, such as water capacity, in that it uses weight differences to measure the amount of $SF_6$ which is adsorbed by a sample which has been pretreated to be substantially free of the adsorbate. $SF_6$ is used in this test since because of its size and shape hinders its entrance into pores having a diameter of less than about 6 Angstroms. It thus can be used as one measurement of available pore mouth and pore diameter shrinkage. This in turn is a measurement of the effect of steaming on the zeolite. In a simplistic description of this method, the sample is preferably predried in a vacuum at 350° C. (662° F.) and weighed. It is then exposed to the $SF_6$ for one hour while the sample is maintained at a temperature of 20° C. (68° F.). The vapor pressure of the $SF_6$ is maintained at that provided by liquid $SF_6$ at 400 Torr. The sample is again weighed to measure the amount of adsorbed $SF_6$. The sample may be suspended on a scale during these steps to facilitate these steps.

In any mass production procedure involving techniques such as steaming and heating there is a possibility for individual particles to be subjected to differing levels of treatment. For instance, particles on the bottom of a pile moving along a belt may not be subjected to the same atmosphere or temperature as the particles which cover the top of the pile. This factor must be considered during manufacturing and also during analysis and testing of the finished product. It is, therefore, recommended that any test measure done on the catalyst is performed on a number of randomly obtained individual pellets to avoid being misled by measurements which performed simultaneously on several particles. For instance, an adsorption capacity measurement made using several pellets reports the average adsorption of all the pellets and does not indicate whether individual particles match adsorption criteria. The average adsorption value could be within specification while the individual particles are not within the specification.

The following examples are provided for illustrative purposes and not to limit the invention as defined in the claims.

EXAMPLE 1

Beta zeolite was obtained from a commercial source and was calcined in air for two hours at a temperature of 650° C. (1202° F.) to remove templating agent. After calcination, the beta zeolite had a silica:alumina molar ratio of 24.2:1 and the $SF_6$ adsorption capacity found in an analytical test of the beta zeolite was 29.3%. Catalyst A was prepared by mixing 0.5 parts by weight of beta zeolite, 48 parts by weight of silica-alumina, and 51.5 parts by weight of alumina in a muller to form a powder mixture. The parts by weight were determined on a volatile-free basis. The silica-alumina had a silica:alumina weight ratio of 78:22. An amount of water and nitric acid that was 4% of the powder mixture on a volatile-free basis was added to the powder mixture to form an extrudable dough. The dough was extruded to form 1/16" (1.6 mm) extrudate, which was calcined at 566° C. (1050° F.). The calcined extrudate was impregnated to incipient wetness with a solution containing $NiNO_3$ and ammonium metatungstate. The wet extrudate was dried and calcined at 510° C. (950° F.) using a belt calciner to form Catalyst A. Catalyst A contained 5.4% Ni and 17.8% W.

EXAMPLE 2

Catalyst B was prepared following the same procedure as that used for preparing Catalyst A, except that the powder mixture was formed by mixing 1 part by weight of beta zeolite, 47.8 parts by weight of silica-alumina, and 51.2 parts by weight of alumina.

EXAMPLE 3

Catalyst C was prepared following the same procedure as that used for preparing Catalyst A, except that the powder mixture was formed by mixing 3 parts by weight of beta zeolite, 46.5 parts by weight of silica-alumina, and 50.5 parts by weight of alumina.

EXAMPLE 4 (COMPARATIVE)

Four batches of the same commercial zeolite beta that was used as a starting material in the preparation of Catalyst A were each calcined to remove templating agent in the manner described in Example 1. Each batch was hydrothermally treated for 110 minutes. One batch was treated at a temperature of 725° C. (1337° F.), one batch was treated at a temperature of 880° C. (1616° F.), and two separate batches were treated at a temperature of 920° C. (1688° F.). The $SF_6$ adsorption capacity of the beta zeolite of each batch was measured, and the results are shown in Table 1.

TABLE 1

| Hydrothermal Treatment Temperature, ° C. | $SF_6$ Adsorption Capacity, wt-% |
|---|---|
| 725 | 26.8 |
| 880 | 17.1 |
| 920 | 12.7 and 13.3 |

EXAMPLE 5 (COMPARATIVE)

Five catalysts, Catalysts D–H, were prepared using as a starting material the same commercial beta zeolite that was used in the preparation of Catalyst A. The beta zeolite for each of Catalysts D–H was calcined to remove templating agent in the manner described in Example 1. During preparation of some of Catalysts D–H beta zeolite was hydrothermally treated at a temperature of 880° C. (1616° F.) for 110 minutes. During the preparation of the remaining Catalysts D–H beta zeolite was hydrothermally treated at a temperature of 920° C. (1688° F.). The amount of beta zeolite for each of Catalysts D–H was within the range of from 5 to 20 wt-% based on the combined weight of beta zeolite and support on a volatile-free basis. For each of Catalysts D–H, the $SF_6$ adsorption capacity of the beta zeolite used for each catalyst was within the range of from 12.7 to 17.1 wt-% following hydrothermal treatment.

EXAMPLE 6

The relative performances of Catalysts A–H were measured by pilot plant scale testing using a vacuum gas oil (VGO) having an API gravity of 22.48 and an end boiling point temperature by simulated distillation of 557° C. (1035° F.). The VGO contained 2.24 wt-% sulfur and 730 wt-ppm nitrogen. The catalysts were presulfided and subjected to a high space velocity in-use aging procedure prior to testing to ensure the test operation was free of startup artifacts. The temperature of the reaction zone during each test was controlled to result in the specified conversion to a collected liquid product at a L.H.S.V. of 1.0 $hr^{-1}$. The reaction zone was operated at a pressure of 14,479 kpa(g) (2100 psi(g)) with hydrogen being circulated at a rate of 1684 n.l/l (10,000 SCFB). Conversion during the testing periods varied between 50 and 80 vol-%. Conversion was defined to be the yield of hydrocarbons boiling below 371° C. (700° F.) resulting from cracking of feed boiling above 371° C. (700° F.).

The drawing is a chart of the 149–371° C. (300–700° F.) cut distillate yield advantage of Catalysts A–H compared to a reference catalyst plotted versus the activity advantage compared to the reference catalyst also and expressed in terms of reactor temperature required to achieve 70% conversion of the VGO. Lower delta reactor temperature requirement indicates higher catalyst activity. The test results for Catalysts A, B, and C are shown in the drawing as triangles that are labeled. The test results for Catalysts D–H are shown in the drawing as diamonds, and a smooth curve has been drawn through the diamonds.

Catalyst A showed a higher yield by about 2 wt-% than the curve for Catalysts D–H at a given delta temperature. Although a slight extrapolation of the curve for Catalysts D–H is required, Catalyst A also appeared to show a higher activity than the curve for Catalysts D–H at a given delta yield. Catalyst B showed a higher yield by about 2.5 wt-% than the curve for Catalysts D–H at a given delta temperature and a higher activity by about 5° C. (10° F.) than the curve for Catalysts D–H at a given delta yield. Although another slight extrapolation of the Catalysts D–H curve is must be done, Catalyst C appeared to show a higher yield than the curve for Catalysts D–H at a given delta temperature and a higher activity than the curve for Catalysts D–H at a given delta yield.

The invention claimed is:

1. A hydrocracking process which comprises contacting a feed stream comprising hydrocarbons having boiling points between about 340° C. and about 565° C. with a catalyst comprising a hydrogenation component and beta zeolite, which hydrogenation component comprises a metal component selected from the group consisting of nickel, cobalt, tungsten, molybdenum, and any combination thereof, which beta zeolite has a silica:alumina molar ratio of less than 30:1 and a $SF_6$ adsorption capacity of at least 28 wt-%.

2. The process of claim 1 further characterized in that the catalyst contains a support and the catalyst contains a positive amount less than 3 wt-% beta zeolite based on the combined weight of the beta zeolite and the support on a volatile-free basis.

3. The process of claim 2 wherein the silica:alumina molar ratio is less than 25:1.

4. The process of claim 3 wherein the silica:alumina molar ratio is more than 9:1 and less than 25:1.

5. The process of claim 1 further characterized in that the catalyst contains a support and the catalyst contains a positive amount less than 2 wt-% beta zeolite based on the combined weight of the beta zeolite and the support on a volatile-free basis.

6. The process of claim 5 wherein the silica:alumina molar ratio is more than 9:1 and less than 25:1.

7. The process of claim 1 further characterized in that the catalyst contains a support and the catalyst contains a positive amount less than 1 wt-% beta zeolite based on the combined weight of the beta zeolite and the support on a volatile-free basis.

8. The process of claim 1 further characterized in that the catalyst contains a support and the catalyst contains a positive amount less than 0.5 wt-% beta zeolite based on the combined weight of the beta zeolite and the support on a volatile-free basis.

9. The process of claim 1 wherein the support comprises a refractory inorganic oxide selected from the group consisting of alumina, silica-alumina, silica, zirconia, titania, boria, and zirconia-alumina, and any combination thereof.

10. The process of claim 1 further characterized in that the catalyst is sulfided prior to contacting with the feed stream.

11. The process of claim 1 wherein the feed stream contains more than 0.01 wt-% nitrogen.

12. The process of claim 1 further characterized in that the beta zeolite has not been treated by steaming to increase its selectivity to the production of middle distillate products prior to the contacting with the feed stream.

13. The process of claim 1 further characterized in that the beta zeolite has been treated by steaming at hydrothermal conditions comprising a temperature of less than or equal to 650° C. prior to the contacting with the feed stream.

14. The process of claim 13 wherein the hydrothermal conditions comprise a steam content of a positive amount less than or equal to 10 mol-% based on the weight of vapors contacting the zeolite beta and a time of a positive amount less than or equal to 2 hours.

15. The process of claim 1 further characterized in that the beta zeolite has been treated by steaming at hydrothermal conditions comprising a temperature of less than or equal to 600° C. prior to the contacting with the feed stream.

16. The process of claim 15 wherein the hydrothermal conditions comprise a steam content of a positive amount less than or equal to 5 mol-% based on the weight of vapors contacting the zeolite beta and a time of a positive amount less than or equal to 2 hours.

17. A hydrocracking process which comprises contacting a feed stream comprising hydrocarbons having boiling points between about 340° C. and about 565° C. with a catalyst comprising a hydrogenation component, a support, and beta zeolite, which beta zeolite has a silica:alumina molar ratio of less than 30:1 and a $SF_6$ adsorption capacity of at least 28 wt-%, which beta zeolite has not been treated by steaming prior to the contacting with the feed stream, which catalyst contains a positive amount less than 1.5 wt-% beta zeolite based on the combined weight of the beta zeolite and the support on a volatile-free basis.

18. The process of claim 17 wherein the silica:alumina molar ratio is less than 25:1.

19. The process of claim 18 wherein the silica:alumina molar ratio is more than 15:1 and less than 25:1.

20. The process of claim 17 wherein the catalyst contains a positive amount less than 1 wt-% beta zeolite based on the combined weight of the beta zeolite and the support on a volatile-free basis.

21. The process of claim 20 wherein the hydrogenation component comprises a metal component selected from the group consisting of nickel, cobalt, tungsten, molybdenum, and any combination thereof.

22. A hydrocracking process which comprises contacting a feed stream comprising hydrocarbons having boiling points between about 340° C. and about 565° C. with a catalyst comprising a hydrogenation component, a support, and beta zeolite, which beta zeolite has a silica:alumina molar ratio of less than 30:1 and a $SF_6$ adsorption capacity of at least 28 wt-%, which beta zeolite has been treated by steaming at a temperature of less than 650° C. and for a time of a positive amount less than 2 hours prior to the contacting with the feed stream, which catalyst contains a positive amount less than 2 wt-% beta zeolite based on the combined weight of the beta zeolite and the support on a volatile-free basis.

23. The process of claim 22 wherein the catalyst contains a positive amount less than 1 wt-% beta zeolite based on the combined weight of the beta zeolite and the support on a volatile-free basis.

24. The process of claim 23 wherein the hydrogenation component comprises a metal component selected from the group consisting of nickel, cobalt, tungsten, molybdenum, and any combination thereof.

25. The process of claim 22 wherein the silica:alumina molar ratio is less than 25:1.

26. The process of claim 25 wherein the silica:alumina molar ratio is more than 9:1 and less than 25:1.

* * * * *